US010724779B2

(12) United States Patent
Flores

(10) Patent No.: US 10,724,779 B2
(45) Date of Patent: Jul. 28, 2020

(54) SYSTEM AND METHOD FOR MANUFACTURING SHAPED ICE

(71) Applicant: Big A Ice Company, LLC, Austin, TX (US)

(72) Inventor: Javier Roberto Flores, Austin, TX (US)

(73) Assignee: Big A Ice Company, LLC, Austin, TX (US)

( * ) Notice: Subject to any disclaimer, the term of this patent is extended or adjusted under 35 U.S.C. 154(b) by 120 days.

(21) Appl. No.: 16/227,827

(22) Filed: Dec. 20, 2018

(65) Prior Publication Data

US 2019/0204000 A1 Jul. 4, 2019

Related U.S. Application Data

(60) Provisional application No. 62/613,630, filed on Jan. 4, 2018.

(51) Int. Cl.

| | |
|---|---|
| ***F25C 5/14*** | (2006.01) |
| ***F25C 5/02*** | (2006.01) |
| ***F25D 25/00*** | (2006.01) |

(52) U.S. Cl.

CPC ..... *F25C 5/14* (2013.01); *F25C 5/02* (2013.01); *F25D 25/005* (2013.01); *F25C 2400/12* (2013.01)

(58) Field of Classification Search

CPC ..... F25C 5/14; F25C 5/02; B26D 7/27; B26D 2210/02; A23G 9/285; A23G 9/08; B23D 53/00

See application file for complete search history.

(56) References Cited

U.S. PATENT DOCUMENTS

| | | | | |
|---|---|---|---|---|
| 219,121 A * | 9/1879 | Slee | ..... | 62/60 |
| 258,566 A * | 5/1882 | Dusenbury | ..... | F25C 1/04 62/340 |
| 1,374,777 A * | 4/1921 | Stoner | ..... | B23D 53/005 83/171 |

(Continued)

FOREIGN PATENT DOCUMENTS

| | | | | |
|---|---|---|---|---|
| GB | 695471 A * | 8/1953 | ..... | F25C 5/14 |

OTHER PUBLICATIONS

Elegant Ice Equipment Lumber Mill (Year: 2017).*

(Continued)

*Primary Examiner* — Christopher R Zerphey

(74) *Attorney, Agent, or Firm* — Dickinson Wright, PLLC; Michael E. Noe, Jr.; Stephen A. Mason

(57) ABSTRACT

A method of manufacturing uniform ice objects includes placing an ice block in a freezer; cutting the ice block into sub-blocks, in the freezer; trimming all sides of each sub-block to ensure smooth, straight cuts on all sides thereof, in the freezer; cutting each trimmed sub-block into sheets, in the freezer, to define a final height of ice objects; cutting each sheet into loins, in the freezer, to define a width of the ice objects; cutting each loin into the ice objects, in the freezer; loading the ice objects in tubs, in the freezer; relocating the tubs of ice objects from the freezer to a refrigerator; removing snow from the ice objects and packaging the ice objects, in the refrigerator; and returning the packaged ice objects to the freezer.

20 Claims, 4 Drawing Sheets

(56) References Cited

U.S. PATENT DOCUMENTS

| | | | | | |
|---|---|---|---|---|---|
| 1,886,321 | A | * | 11/1932 | Walker | B23D 53/06 83/166 |
| 1,959,184 | A | * | 5/1934 | Walker | B23D 53/04 83/167 |
| 2,045,183 | A | * | 6/1936 | Fowle | B65D 5/48038 426/119 |
| 2,156,247 | A | * | 4/1939 | Smith | B23D 45/102 83/878 |
| 2,171,264 | A | * | 8/1939 | Campbell | B23D 45/102 83/790 |
| 2,654,404 | A | * | 10/1953 | Neuhauser | B23D 57/026 83/808 |
| 3,576,146 | A | * | 4/1971 | Adams | B23D 45/10 83/408 |
| 5,189,939 | A | * | 3/1993 | Allen, Jr. | B23D 61/025 83/149 |
| 5,460,068 | A | * | 10/1995 | Gwosdz | B23D 57/026 83/168 |

OTHER PUBLICATIONS

Elegant Ice Equipment Bandsaw (Year: 2017).*
Norfo Automatic Block Sawing Line for Fishblocks or Minceblocks (Year: 2000).*

* cited by examiner

SYSTEM AND METHOD FOR MANUFACTURING SHAPED ICE

CROSS-REFERENCE TO RELATED APPLICATIONS

This application claims priority to and the benefit of U.S. Prov. Pat. App. No. 62/613,630, filed Jan. 4, 2018, which is incorporated herein by reference in its entirety.

TECHNICAL FIELD

This application generally relates to ice and, in particular, to a system, method and apparatus for manufacturing shaped ice.

STATEMENT OF FEDERALLY FUNDED RESEARCH

None.

BACKGROUND OF THE DISCLOSURE

Conventional ice making machines produce ice cubes or other ice shapes that typically are not transparent and clear due to the presence of trapped bubbles. Moreover, the uniformity of the ice made by conventional ice making machines usually lacks precision. Although these designs are workable, improvements in the quality and consistency of shaped ice continue to be of interest.

SUMMARY OF THE DISCLOSURE

Embodiments of a system, method and apparatus for manufacturing shape ice objects is disclosed. For example, a method of manufacturing uniform ice objects can include placing an ice block in a freezer; cutting the ice block into sub-blocks, in the freezer; trimming all sides of each sub-block to ensure smooth, straight cuts on all sides thereof, in the freezer; cutting each trimmed sub-block into sheets, in the freezer, to define a final height of ice objects; cutting each sheet into loins, in the freezer, to define a width of the ice objects; cutting each loin into the ice objects, in the freezer; loading the ice objects in tubs, in the freezer; relocating the tubs of ice objects from the freezer to a refrigerator; removing snow from the ice objects and packaging the ice objects, in the refrigerator; and returning the packaged ice objects to the freezer.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the embodiments thereof that are illustrated in the appended drawings. However, the drawings illustrate only some embodiments and therefore are not to be considered limiting in scope as there can be other equally effective embodiments.

The use of the same reference symbols in different drawings indicates similar or identical items.

DETAILED DESCRIPTION OF THE DISCLOSURE

Figure 1:
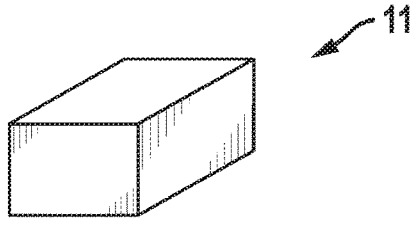
FIG. 1 is a schematic, isometric view of an ice block.

FIGS. 1-9 depict embodiments of a system, method and apparatus for manufacturing high purity, highly uniform ice objects (such as ice cubes), is disclosed. The drawings are schematic and sizes of the various components shown in the drawings are not to scale. In an example, FIGS. 1-9 illustrate equipment and a process having a first step of receiving very high purity ice blocks 11. The ice blocks 11 can be formed from a machine that uses reverse osmosis, filtered water having extremely high purity and extremely low air content (e.g., small air pockets, such as bubbles). In one version, such a machine can be produced by Clinebell Equipment Company of Loveland, Colo. Examples of the ice blocks 11 can be large and each weigh at least 100 pounds. In an example, each ice block 11 can weigh about 300 pounds, and have dimensions of about 40 inches in length, by about 20 inches wide, by about 10 inches in height.

Figure 2:
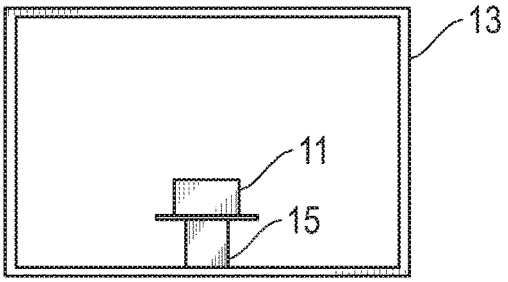
FIGS. 2-4 are schematic drawings of embodiments of product and method steps for manufacturing shaped ice.
Figure 3:
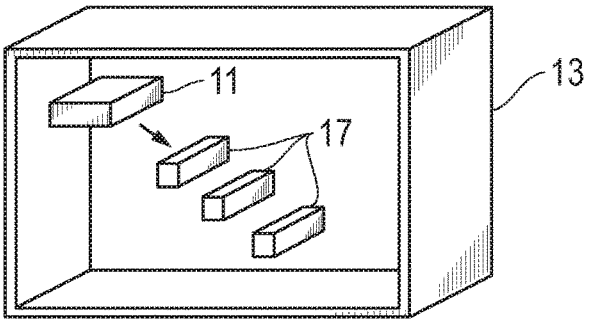
Figure 4:
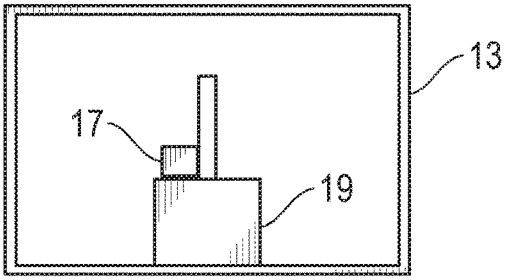
Figure 5:
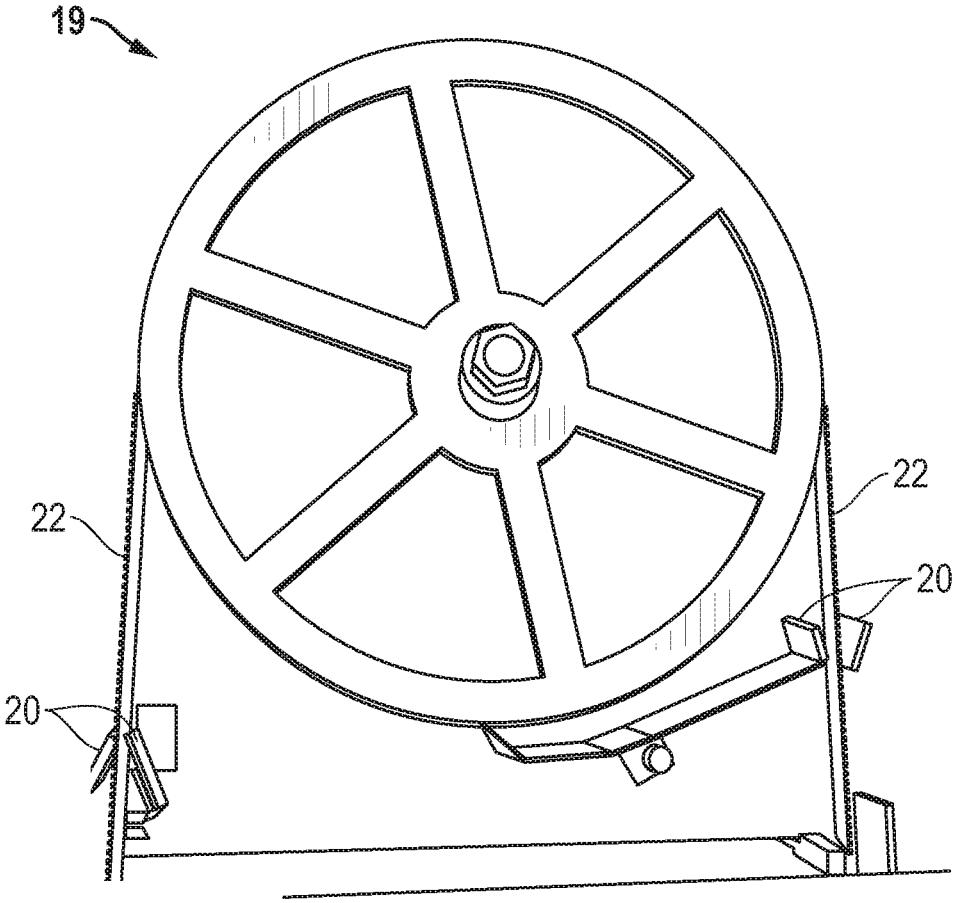
FIG. 5 is a schematic drawing of an embodiment of a tool for the method of manufacturing shaped ice.
Figure 6:
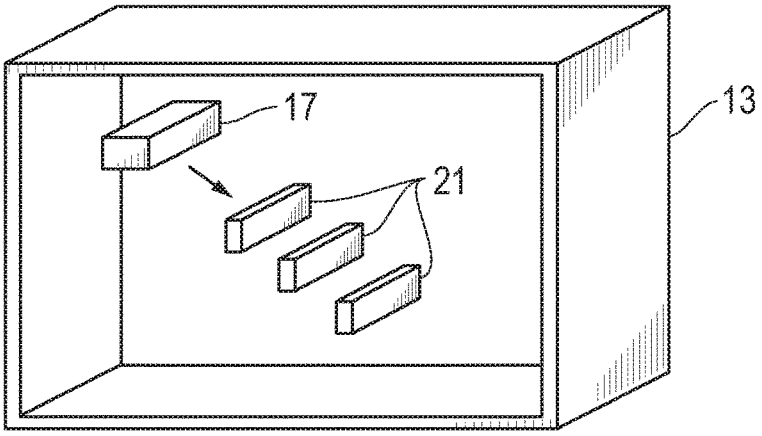
FIGS. 6-9 are schematic drawings of embodiments of other product and method steps for manufacturing shaped ice.
Figure 7:
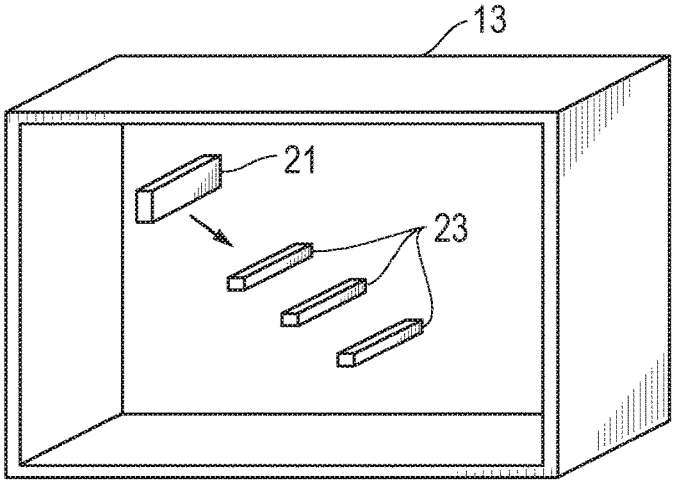
Figure 8:
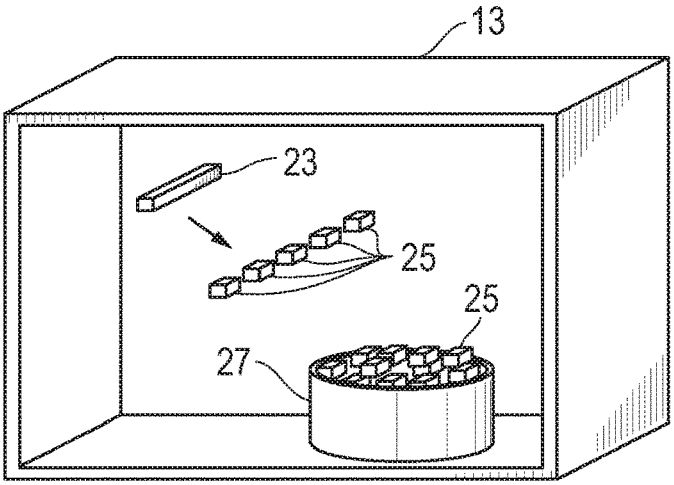
Figure 9:
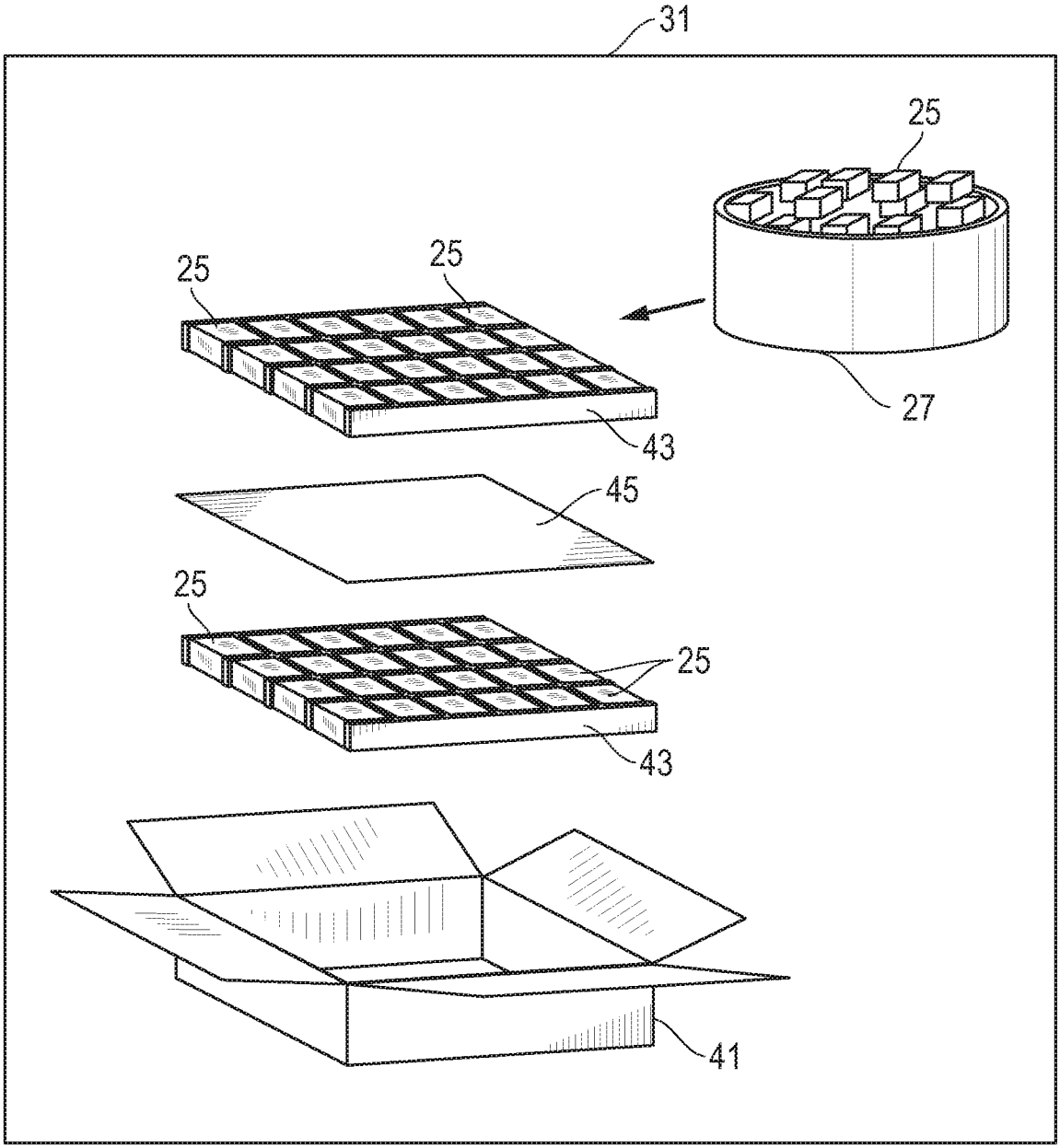

As shown in FIGS. 1 and 2, the ice blocks 11 are received and placed in a room comprising a freezer 13, such as on a platform 15. In some examples, the ice blocks 11 are allowed to temper in the freezer for at least about 12 hours. Tempering allows the ice blocks 11 to reach a temperature at which it is safe to cut into smaller pieces. For example, the temperature of freezer 13 can be about 10° F. The temperature of the freezer 13 can be tightly controlled during the process, such as about +/−5° F., or about 5° F. to about 15° F.

Each ice block 11 can be carefully measured and divided into two or more sub-blocks 17 (FIG. 3) while in the freezer 13. For example, one ice block 11 can be divided into three sub-blocks 17. In one version, the ice block 11 is manually cut into the sub-blocks 17 with a chainsaw, such as an electric chainsaw by Stihl Inc. of Virginia Beach, Va.

The sub-blocks 17 can then be placed on a band saw 19 (FIG. 4) located inside the freezer 13. An example of the band saw 19 can comprise a Biro Model 3334 Power Meat Cutter of Marblehead, Ohio. The band saw 19 can be used to trim all six sides of the sub-block 17 to ensure smooth, straight cuts on all six sides of the sub-block 17. Such trimming also can remove and/or eliminate any irregularities or curvature in the sub-block 17. In addition, the band saw 19 can include one or more (e.g., two arrays of two) blade cleaners 20 (FIG. 5) for its blade 22. One blade cleaner 20 can be located adjacent to each side of the cutting area of the blade 22 of the band saw 19. The blade cleaners 20 can be arrayed in opposed pairs on opposite sides of the blade 22, as shown. Examples of the blade cleaners 20 can comprise a polymer or plastic (e.g., nylon), such as Nyleen Biro blade cleaners, Model B004-131N from Davison's Butcher Supply of Commerce, Calif. In some embodiments, metallic blade cleaners are not used in the process.

In a next step of the process, each trimmed sub-block 17 is cut by the band saw 19 into two or more sheets 21 (FIG. 6) while inside the freezer 13. Each sheet 21 can comprise a final "height" of the shaped ice object that it will ultimately form. For example, the final height can be the height of the ice cubes 25 shown in FIG. 8. This process can ensure that all ice objects are cut to substantially the exact same height, instead of adjusting the band saw 19, which could potentially and inadvertently vary the height.

The process may further include cutting each sheet 21 into two or more loins 23 (FIG. 7) with the band saw 19 in the freezer 13. Each loin 23 can be substantially identical in height (as noted above for sheets 21) as well as width. The width can be the final width of the ice objects, such as the width of the ice cubes 25, that ultimately will be formed.

Embodiments of the process can further include cutting each loin 23 into two or more ice cubes 25 (FIG. 8) with the band saw 19 in the freezer 13. Each ice cube 25 can be substantially identical in height, width and length. For example, each of the height, width and length can be any desired dimensions. In some versions, the shaped objects can be square cubes or rectangular cubes. For example, the shaped object can be a standard cube having 2 inch sides, a whiskey cube having 1.8 inch sides, a double rock having dimensions of 2 inches by 2 inches by 2.5 inches, or a Collins shaped ice object having dimensions of 1.25 inches by 1.25 inches by 5 inches. The variances of size of the respective ice objects can be minimal, and adjustments to the process and equipment are made throughout the method to ensure that the desired, respective ice objects are as identical as possible. For example, dimensionally, the final ice objects can vary from each other by not greater than about 0.1 inches or less, in any dimension, such as with respect to any other same type of ice cube 25 formed from loins 23.

In addition, each cutting procedure described herein can comprise using a food grade white oil or butcher's oil to lubricate the cutting blades during each step. The use of white oil can reduce the amount of time it takes to make each cut. In addition, the white oil can be applied to a bottom wheel of the band saw 19 to avoid snow build up during cutting of the ice. Such oil can meet or exceed both FDA and USDA requirements, and leave little to no residue on the final ice products.

While in the freezer 13, the ice cubes 25 can be placed in tubs 27 and stocked until they are ready to be packed. The ice cubes 25 are not over-stacked or over-filled in the tubs 27 to avoid sticking between the ice cubes 25 with pressure and time. For example, the tubs 27 can comprise restaurant grade bus tubs having a volume of about 10 to 12 gallons. Such tubs 27 can hold about only 40 to 50 pounds of ice cubes 25, again to help prevent them from sticking. The ice cubes 25 remain in the tubs 27 for a minimal amount of time (e.g., no more than about 30 minutes) prior to packing.

Subsequent steps of the process can take place outside of the freezer 13, such as in a room comprising a refrigerator 31. For example, the temperature of the refrigerator 31 can be about 38° F. In some versions, the temperature of the refrigerator 31 can be tightly controlled, such as about +2° F. to about-5° F., or about 40° F. to about 33° F.

Once the tubs 27 of ice cubes 25 are placed in the refrigerator 31, the ice cubes 25 can be brushed for excess snow present from the cutting process. The warmer temperature of the refrigerator 31 (relative to the freezer 13) can facilitate the snow removal process since the snow tends to stick to the ice cubes 25 in the freezer 13. The ice cubes 25 also are inspected for quality and then packaged. The packing and packaging can take place in the refrigerator 31 or, alternatively, in the freezer 13. The time between removing the freshly cut ice cubes in tubs 27 from the freezer 13, to returning the packed and packaged ice cubes 25 to the freezer 13 is minimal, such as no more than about 30 to 45 minutes.

Embodiments of the ice cubes 25 can be carefully packed in food grade poly-press containers. For example, the food grade poly-press containers can include a corrugated box 41, divider boards or dividers 43 to separate each individual ice cube 25 in length and width directions, and pads 45 to separate vertical layers of the ice cubes 25 in the dividers 43 in the corrugated box 41. Such arrangements can prevent sticking between the ice cubes 25 inside corrugated box 41.

Versions of the food grade poly-press containers can include a selected range of thickness of food grade wax coating. For example, the food grade wax coating can have a thickness of about 0.003 inches to about 0.009 inches, such as about 0.006 inches, on each surface that contacts the ice. At least one surface of each of the corrugated boxes 41, dividers 43 and pads 45 can include this thickness of food grade wax coating. Such wax thicknesses can exceed both FDA and USDA requirements. The overall thickness of each wall of the dividers 43, including the food grade wax coating(s), can be about 0.02 inches to about 0.06 inches, such as about 0.04 inches.

Other versions can include one or more of the following embodiments.

1. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) relocating the tubs of ice objects from the freezer to a refrigerator;

(i) removing snow from the ice objects and packaging the ice objects, in the refrigerator; and then (j) returning the packaged ice objects to the freezer.

2. The method of any of these embodiments, wherein step (a) further comprises tempering the ice blocks in the freezer for at least about 12 hours.

3. The method of any of these embodiments, further comprising maintaining the freezer at a temperature of at least about 5° F. and not greater than about 15° F.

4. The method of any of these embodiments, further comprising forming the ice objects with respective dimensions that vary from each other by not greater than about 0.1 inches.

5. The method of any of these embodiments, wherein step (b) comprises cutting with an electric chain saw.

6. The method of any of these embodiments, wherein steps (c) through (f) comprise cutting with a band saw.

7. The method any of these embodiments, wherein steps (c) through (f) comprise cleaning a blade of the band saw with polymer blade cleaners on opposed sides of the blade.

8. The method any of these embodiments, wherein steps (c) through (f) comprise lubricating the blade with a food grade white oil.

9. The method of any of these embodiments, wherein step (g) comprises loading no more than about 50 pounds of the ice objects in each tub.

10. The method of any of these embodiments, wherein steps (g) and (h) comprise retaining the ice objects in the tubs for not greater than about 30 minutes prior to packing.

11. The method of any of these embodiments, wherein steps (h) and (i) comprise retaining the ice objects in the refrigerator for not greater than about 45 minutes.

12. The method of any of these embodiments, further comprising maintaining the refrigerator at a temperature of at least about 33° F. and not greater than about 40° F.

13. The method of any of these embodiments, wherein step (i) comprises packing the ice objects in food grade poly-press containers comprising boxes, dividers in the boxes to separate horizontally adjacent ones of the ice objects, and pads in the boxes to separate vertically adjacent ones of the ice objects.

14. The method of any of these embodiments, further comprising providing each ice-contacting side of the food grade poly-press containers with a food grade wax coating having a thickness of about 0.003 inches to about 0.009 inches.

15. The method of any of these embodiments, further comprising providing each divider with walls, and each wall comprises an overall thickness, including the food grade wax coatings, of at least about 0.02 inches and not greater than about 0.06 inches.

16. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) removing snow from the ice objects and packaging the ice objects;

(i) wherein steps (c) through (f) comprise cleaning a blade of the band saw with polymer blade cleaners on opposed sides of the blade, and lubricating the blade with a food grade white oil.

17. The method of any of these embodiments, wherein step (a) further comprises tempering the ice blocks in the freezer for at least about 12 hours; and the method further comprises:

maintaining the freezer at a temperature of at least about 5° F. and not greater than about 15° F.;

maintaining the refrigerator at a temperature of at least about 33° F. and not greater than about 40° F.; and forming the ice objects with respective dimensions that vary from each other by not greater than about 0.1 inches.

18. The method of any of these embodiments, wherein step (b) comprises cutting with an electric chain saw, steps (c) through (f) comprise cutting with a band saw, and step (g) comprises loading no more than about 50 pounds of the ice objects in each tub.

19. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) removing snow from the ice objects and packaging the ice objects in food grade poly-press containers comprising boxes, dividers in the boxes to separate horizontally adjacent ones of the ice objects, and pads in the boxes to separate vertically adjacent ones of the ice objects; and (i) providing each ice-contacting side of the food grade poly-press containers with a food grade wax coating having a thickness of about 0.003 inches to about 0.009 inches, providing each divider with walls, and each wall comprises an overall thickness, including the food grade wax coatings, of at least about 0.02 inches and not greater than about 0.06 inches.

20. The method of any of these embodiments, wherein step (a) further comprises tempering the ice blocks in the freezer for at least about 12 hours, step (b) comprises cutting with an electric chain saw, steps (c) through (f) comprise cutting with a band saw, and step (g) comprises loading no more than about 50 pounds of the ice objects in each tub; and the method further comprises:

maintaining the freezer at a temperature of at least about 5° F. and not greater than about 15° F.;

maintaining the refrigerator at a temperature of at least about 33° F. and not greater than about 40° F.; and forming the ice objects with respective dimensions that vary from each other by not greater than about 0.1 inches.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The term "discreet," as well as derivatives thereof, references to the amount of skin exposed by a user of the garment, rather than the type of style of the garment. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) relocating the tubs of ice objects from the freezer to a refrigerator;

(i) removing snow from the ice objects and packaging the ice objects, in the refrigerator;

and then (j) returning the packaged ice objects to the freezer.

2. The method of claim 1, wherein step (a) further comprises tempering the ice blocks in the freezer for at least about 12 hours.

3. The method of claim 1, further comprising maintaining the freezer at a temperature of at least about 5° F. and not greater than about 15° F.

4. The method of claim 1, further comprising forming the ice objects with respective dimensions that vary from each other by not greater than about 0.1 inches.

5. The method of claim 1, wherein step (b) comprises cutting with an electric chain saw.

6. The method of claim 1, wherein steps (c) through (f) comprise cutting with a band saw.

7. The method of claim 6, wherein steps (c) through (f) comprise cleaning a blade of the band saw with polymer blade cleaners on opposed sides of the blade.

8. The method of claim 7, wherein steps (c) through (f) comprise lubricating the blade with a food grade white oil.

9. The method of claim 1, wherein step (g) comprises loading no more than about 50 pounds of the ice objects in each tub.

10. The method of claim 1, wherein steps (g) and (h) comprise retaining the ice objects in the tubs for not greater than about 30 minutes prior to packing.

11. The method of claim 1, wherein steps (h) and (i) comprise retaining the ice objects in the refrigerator for not greater than about 45 minutes.

12. The method of claim 1, further comprising maintaining the refrigerator at a temperature of at least about 33° F. and not greater than about 40° F.

13. The method of claim 1, wherein step (i) comprises packing the ice objects in food grade poly-press containers comprising boxes, dividers in the boxes to separate horizontally adjacent ones of the ice objects, and pads in the boxes to separate vertically adjacent ones of the ice objects.

14. The method of claim 13, further comprising providing each ice-contacting side of the food grade poly-press containers with a food grade wax coating having a thickness of about 0.003 inches to about 0.009 inches.

15. The method of claim 14, further comprising providing each divider with walls, and each wall comprises an overall thickness, including the food grade wax coatings, of at least about 0.02 inches and not greater than about 0.06 inches.

16. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) relocating the tubes of ice objects from the freezer to a refrigerator;

(i) removing snow from the ice objects and packaging the ice objects;

(j) wherein steps (c) through (f) comprise cutting with a band saw and cleaning a blade of the band saw with polymer blade cleaners on opposed sides of the blade, and lubricating the blade with a food grade white oil.

17. The method of claim 16, wherein step (a) further comprises tempering the ice blocks in the freezer for at least about 12 hours; and the method further comprises:

maintaining the freezer at a temperature of at least about 5° F. and not greater than about 15° F.;

maintaining the refrigerator at a temperature of at least about 33° F. and not greater than about 40° F.; and forming the ice objects with respective dimensions that vary from each other by not greater than about 0.1 inches.

18. The method of claim 16, wherein step (b) comprises cutting with an electric chain saw, and step (g) comprises loading no more than about 50 pounds of the ice objects in each tub.

19. A method of manufacturing uniform ice objects, comprising:

(a) placing an ice block in a freezer;

(b) cutting the ice block into sub-blocks, in the freezer;

(c) trimming all sides of each sub-block to ensure smooth, straight cuts on all sides thereof, in the freezer;

(d) cutting each trimmed sub-block into sheets, in the freezer, to define a final height of ice objects;

(e) cutting each sheet into loins, in the freezer, to define a width of the ice objects;

(f) cutting each loin into the ice objects, in the freezer;

(g) loading the ice objects in tubs, in the freezer;

(h) relocating the tubes of ice objects from the freezer to a refrigerator;

(i) removing snow from the ice objects and packaging the ice objects in food grade poly-press containers comprising boxes, dividers in the boxes to separate horizontally adjacent ones of the ice objects, and pads in the boxes to separate vertically adjacent ones of the ice objects; and (j) providing each ice-contacting side of the food grade poly-press containers with a food grade wax coating having a thickness of about 0.003 inches to about 0.009 inches, providing each divider with walls, and each wall comprises an overall thickness, including the food grade wax coatings, of at least about 0.02 inches and not greater than about 0.06 inches.

20. The method of claim 19, wherein step (a) further comprises tempering the ice blocks in the freezer for at least about 12 hours, step (b) comprises cutting with an electric chain saw, steps (c) through (f) comprise cutting with a band saw, and step (g) comprises loading no more than about 50 pounds of the ice objects in each tub; and the method further comprises:

maintaining the freezer at a temperature of at least about 5° F. and not greater than about 15° F.;

maintaining the refrigerator at a temperature of at least about 33° F. and not greater than about 40° F.; and forming the ice objects with respective dimensions that vary from each other by not greater than about 0.1 inches.

* * * * *